US009014378B2

(12) United States Patent
Chabanne

(10) Patent No.: US 9,014,378 B2
(45) Date of Patent: Apr. 21, 2015

(54) ENHANCING THE REPRODUCTION OF MULTIPLE AUDIO CHANNELS

(75) Inventor: Christophe Chabanne, San Mateo, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 311 days.

(21) Appl. No.: 13/061,553

(22) PCT Filed: Aug. 27, 2009

(86) PCT No.: PCT/US2009/055118

§ 371 (c)(1),
(2), (4) Date: Mar. 1, 2011

(87) PCT Pub. No.: WO2010/027882

PCT Pub. Date: Mar. 11, 2010

(65) Prior Publication Data

US 2011/0164755 A1 Jul. 7, 2011

Related U.S. Application Data

(60) Provisional application No. 61/190,963, filed on Sep. 3, 2008.

(51) Int. Cl.
*H04R 5/00* (2006.01)
*H04S 3/00* (2006.01)

(52) U.S. Cl.
CPC ..... *H04S 3/002* (2013.01)

(58) Field of Classification Search
USPC ..... 381/1, 17, 18, 300, 307, 303
See application file for complete search history.

(56) References Cited

U.S. PATENT DOCUMENTS

| | | | | |
|---|---|---|---|---|
| 4,612,663 | A * | 9/1986 | Holbrook et al. | 381/307 |
| 4,837,825 | A | 6/1989 | Shivers | |
| 4,932,059 | A | 6/1990 | Fosgate | |
| 5,172,415 | A | 12/1992 | Fosgate | |
| 5,263,087 | A | 11/1993 | Fosgate | |
| 5,708,718 | A | 1/1998 | Ambourn | |
| 5,748,746 | A | 5/1998 | Ozaki | |
| 5,857,026 | A | 1/1999 | Scheiber | |
| 6,760,448 | B1 | 7/2004 | Gundry | |
| 6,961,433 | B2 | 11/2005 | Ishii | |
| 7,558,393 | B2 * | 7/2009 | Miller, III | 381/307 |
| 8,199,921 | B2 | 6/2012 | Katayama | |
| 2003/0007648 | A1 | 1/2003 | Currell | |
| 2004/0062401 | A1 | 4/2004 | Davis | |

(Continued)

FOREIGN PATENT DOCUMENTS

| | | |
|---|---|---|
| CN | 101009952 | 8/2007 |
| EP | 0325175 | 7/1989 |

(Continued)

OTHER PUBLICATIONS

Plomp, et al., "Tonal Consonance and Critical Bandwidth" JASA, vol. 38, 1965, pp. 548-560.

(Continued)

*Primary Examiner* — Duc Nguyen
*Assistant Examiner* — Phan Le

(57) ABSTRACT

This invention relates to the field of multichannel audio. More particularly, the invention relates to a method for the provision of audio channels suitable for application to loudspeakers located above conventional front loudspeakers.

16 Claims, 3 Drawing Sheets

(56) References Cited

U.S. PATENT DOCUMENTS

| | | | | |
|---|---|---|---|---|
| 2004/0247135 | A1 | 12/2004 | Dressler | |
| 2007/0140497 | A1 | 6/2007 | Moon | |
| 2007/0253583 | A1* | 11/2007 | Melanson | 381/303 |
| 2008/0130905 | A1* | 6/2008 | Fincham | 381/18 |
| 2008/0205675 | A1 | 8/2008 | Kutuzov | |
| 2009/0110204 | A1* | 4/2009 | Walsh et al. | 381/17 |

FOREIGN PATENT DOCUMENTS

| | | |
|---|---|---|
| JP | H05-191897 | 7/1993 |
| JP | 2007-081927 | 3/2007 |
| JP | 2007-300403 | 11/2007 |
| JP | 2008-186899 | 8/2008 |
| KR | 10-2007-0073536 | 7/2007 |
| RU | 2329548 | 7/2008 |
| TW | 569551 | 1/2004 |
| TW | 1313857 | 10/2006 |
| WO | 2005/101371 | 10/2005 |

OTHER PUBLICATIONS

Furness, Roger K., "Ambisonics—An Overview" AES 8th International Conference, pp. 181-190, May 1990.

Gerzon, Michael A. "Ambisonics in Multichannel Broadcasting and Video" Presented at the 74th Convention of the Audio Engineering Society, New York, Oct. 8-12, 1983, vol. 33, No. 11, Nov. 1985, pp. 859-871.

Audio Pulse Model 1 Owners Manual, relevant page "Using the Additional taps for 6-Channel or 8-Channel Operation" This undated publication is believed to have been published at least as early as 1977, which year of publication is sufficiently earlier than the effective U.S. filing date and any foreign priority date so that the particular month of publication is not an issue. (See MPEP 609.04a).

Jot, et al., "Spatial Enhancement of Audio Recordings" Proceedings of the International AES Conference May 23, 2003, pp. 1-11.

Miller, III, Robert E., "Transforming Ambiophonic + Ambisonic 3D Surround Sound to & from ITU 5.1/6.1" Audio Engineering Society Convention Paper 5799, Presented at the 114th Convention, Mar. 22-25, 2003 Amsterdam, Netherlands.

* cited by examiner

ENHANCING THE REPRODUCTION OF MULTIPLE AUDIO CHANNELS

CROSS-REFERENCE TO RELATED APPLICATIONS

This application claims priority to U.S. Patent Provisional Application No. 61/190,963, filed 3 Sep. 2008, hereby incorporated by reference in its entirety.

FIELD OF THE INVENTION

This invention relates to the field of multichannel audio. More particularly, the invention relates to a method for the provision of audio channels suitable for application to loudspeakers located above conventional front loudspeakers. The invention also relates to apparatus for performing the method and a computer program for performing the method.

SUMMARY OF THE INVENTION

In accordance with aspects of the invention, a method of enhancing the reproduction of multiple audio channels, the channels including channels intended for playback to the front of a listening area and channels intended for playback to the sides and/or rear of the listening area, comprises extracting out-of-phase sound information from a pair of the channels intended for playback to the sides or rear sides of the listening area, and applying the out-of-phase sound information to one or more loudspeakers located above loudspeakers playing back channels intended for playback to the front of the listening area.

The extracting may extract two sets of out-of-phase information and the applying may apply the first set of out-of-phase information to one or more left vertical height loudspeakers located above one or more left loudspeakers playing back a channel or channels intended for playback to the left front of the listening area and may apply the second set of out-of-phase information to one or more right vertical height loudspeakers located above one or more right loudspeakers playing back a channel or channels intended for playback to the right front of the listening area. According to a first alternative, the extracting may extract a single-channel monophonic audio signal comprising out-of-phase components in the pair of channels and divide the monophonic audio signal into two signals, a left vertical height signal and a right vertical height signal, for coupling, respectively, to the left vertical height and right vertical height loudspeakers. According to a second alternative, extracting may extract two audio signals, a left vertical height signal and a right vertical height signal, for coupling, respectively, to the left vertical height and right vertical height loudspeakers, each of which vertical height signals comprises out-of-phase components in the pair of channels, the left vertical height signal being weighted to the left side and/or left rear side channel in the pair of channels and the right vertical height signal being weighted to the right side and/or right rear side channel in the pair of channels.

The signals applied to the left vertical height and right vertical height loudspeakers preferably are in phase with each other in order to minimize out-of-phase signal cancellation at particular positions in the listening area.

According to the first of three alternatives, there is one pair of channels intended for playback to the sides and/or rear sides of the listening area, a left surround channel and a right surround channel. According to the second of the three alternatives, there is one pair of channels intended for playback to the sides and/or rear sides of the listening area, a left rear surround channel and a right rear surround channel. According to the third of the three alternatives, there are two pairs of channels intended for playback to the sides and/or rear sides of the listening area, a pair of side surround channels and a pair of rear surround channels, and wherein the pair of side surround channels are the left surround and right surround channels and the pair of rear surround channels are the left rear surround and right rear surround channels.

The extracting may extract the out-of-phase sound information using a passive matrix. The pair of channels from which the out-of-phase sound information is extracted may be designated Ls and Rs and the extracted out-of-phase sound information may be designated Lvh and Rvh, such that the relationships among Lvh, Rvh, Ls and Rs may be characterized by $$Lvh=[(0.871*Ls)-(0.49*Rs)], \text{ and}$$

$$Rvh=[(-0.49*Ls)+(0.871*Rs)].$$

Alternatively, the extracting may extract the out-of-phase sound information using an active matrix.

The multiple audio channels may be derived from a pair of audio source signals. The pair of audio signals may be a stereophonic pair of audio signals into which directional information is encoded. Alternatively, the multiple audio channels may be derived from more than two audio source signals comprising independent signals representing respective channels intended for playback to the front of the listening area and to the sides and/or rear of the listening area. A pair of independent signals representing respective channels intended for playback to the sides and/or rear of the listening area may be encoded with out-of-phase vertical height information.

None of FIGS. 1-6 is to scale.

FIGS. 7-10 show examples of various ways according to aspects of the present invention in which signals for applying to loudspeakers at the Lvh and Rvh loudspeaker locations may be obtained.

DESCRIPTION OF THE INVENTION

Figure 1:
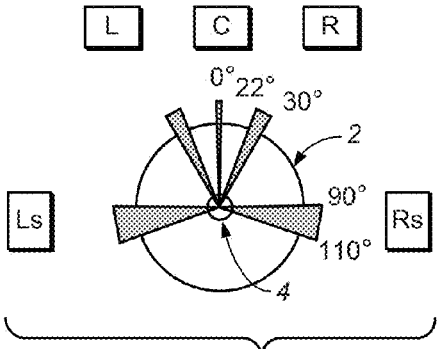
FIG. 1 is a schematic plan view of an environment showing idealized loudspeaker locations for reproducing left (L), center (C), and right (R) audio channels intended for playback to the front of a listening area and left surround (Ls) and right surround (Rs) audio channels intended for playback to the sides of a listening area.

FIG. 1 is a schematic plan view of an environment showing idealized loudspeaker locations for reproducing left (L), center (C), and right (R) audio channels intended for playback to the front of a listening area and left surround (Ls) and right surround (Rs) audio channels intended for playback to the sides of a listening area. Such arrangements typically also include an "LFE" (low frequency effects) loudspeaker (such as a subwoofer) and are often referred to as "5.1" channel playback arrangements (five main channels plus the LFE channel). For simplicity in presentation, no further reference will be made to the LFE channel, it not being necessary to the exposition or understanding of the invention.

A notional listening area 2 having a center 4 is shown among the five idealized loudspeaker locations. Setting the center loudspeaker location at 0 degrees with respect to the listening area center, the other loudspeaker locations may have a range of relative angular locations as shown—the right loudspeaker location from 22 to 30 degrees (the left being the mirror image location range) and the right surround loudspeaker location from 90 to 110 degrees (the left surround being the minor image location range).

Figure 2:
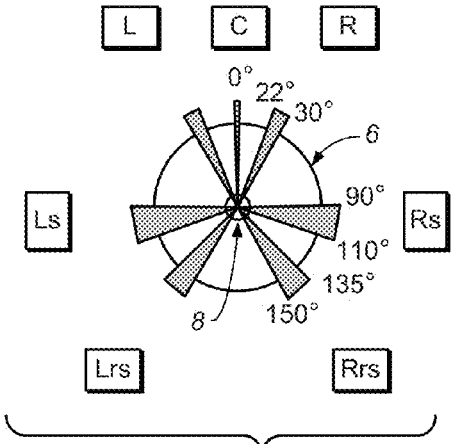
FIG. 2 is a schematic plan view of an environment showing idealized loudspeaker locations for reproducing left (L), center (C), and right (R) audio channels intended for playback to the front of a listening area and left surround (Ls). right surround (Rs), left rear surround (Lrs) and right rear surround (Rrs) audio channels intended for playback to the sides and rear sides of a listening area.

FIG. 2 is a schematic plan view of an environment showing idealized loudspeaker locations for reproducing left (L), center (C), and right (R) audio channels intended for playback to the front of a listening area and left surround (Ls), right surround (Rs), left rear surround (Lrs) and right rear surround (Rrs) audio channels intended for playback to the sides and rear sides of a listening area. Such arrangements typically are often referred to as "7.1" channel playback arrangements (seven main channels plus an LFE channel).

A notional listening area 6 having a center 8 is shown among the seven idealized loudspeaker locations. Setting the center loudspeaker location at 0 degrees with respect to the listening area center, the other loudspeaker locations may have a range of relative angular locations as shown—the right loudspeaker location from 22 to 30 degrees (the left being the mirror image location range), the right surround loudspeaker location from 90 to 110 degrees (the left surround being the mirror image location range), and the right rear surround loudspeaker location (the left rear surround being the mirror image location range).

Figure 3:
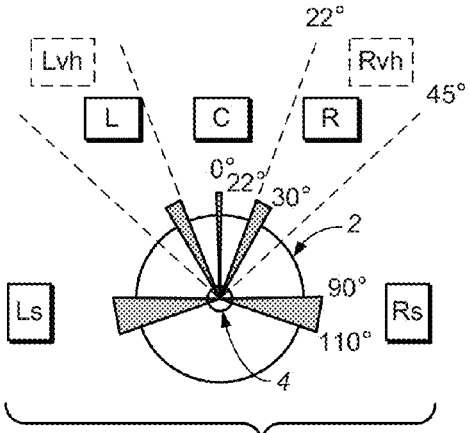
FIG. 3 shows the FIG. 1 example to which vertical height loudspeaker locations in accordance with aspects of the present invention have been added.

FIG. 3 shows the FIG. 1 example to which vertical height loudspeaker locations in accordance with aspects of the present invention have been added. A right vertical height (Rvh) loudspeaker location is shown in dashed lines (to indicate that it is above the right (R) loudspeaker location) within an angle range of 22 to 45 degrees with respect to the listening area center 4. A left vertical height (Lvh) loudspeaker location is shown in dashed lines (to indicate that it is above the left (L) loudspeaker location) within a mirror image of the angle range of 22 to 45 degrees with respect to the listening area center 4.

Figure 4:
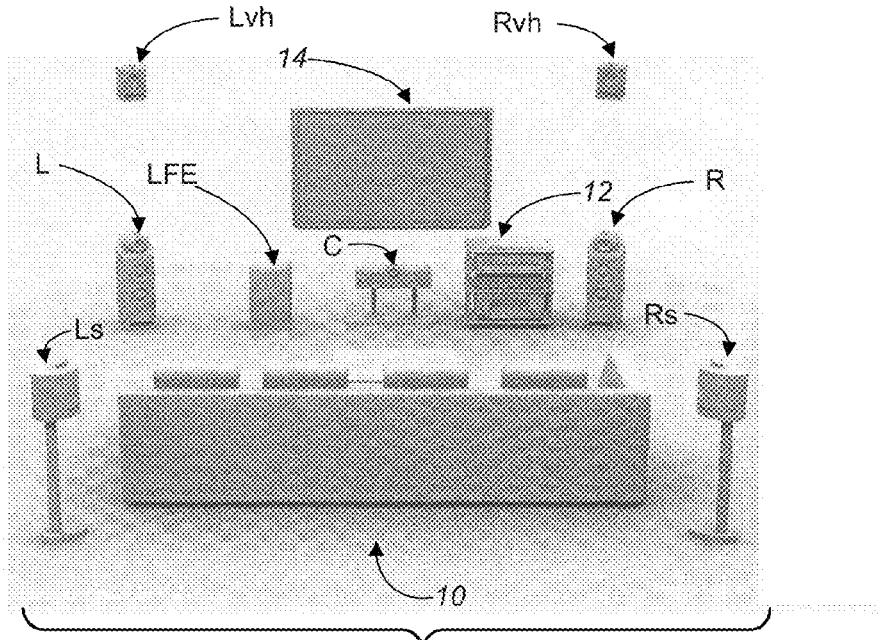
FIG. 4 shows the FIG. 3 example in a small room environment.

FIG. 4 shows the FIG. 3 example in a small room environment. A sofa 10 is located in the listening area 2. Loudspeakers are located at the L, LFE, C, R, Lvh, Rvh, Ls and Rs loudspeaker locations. Equipment associated with the multiple audio channels are shown schematically at 12. A video screen 13 is located above the center loudspeaker location.

It will be noted that the Lvh and Rvh loudspeaker locations are above the loudspeaker locations of the front audio channels. For example, it has been found that suitable Lvh and Rvh loudspeaker locations are at least one meter above the L and R loudspeaker locations and as high as possible. Also, although it has been found that the Lvh and Rvh loudspeaker locations may be at an angle wider than the L and R loudspeaker locations (up to 45 degrees rather than 30 degrees, for example), the Lvh and Rvh loudspeaker locations preferably are substantially directly above the L and R loudspeaker locations. It will also be noted that the Lvh and Rvh loudspeaker locations are above the Ls and Rs loudspeaker locations.

Figure 5:
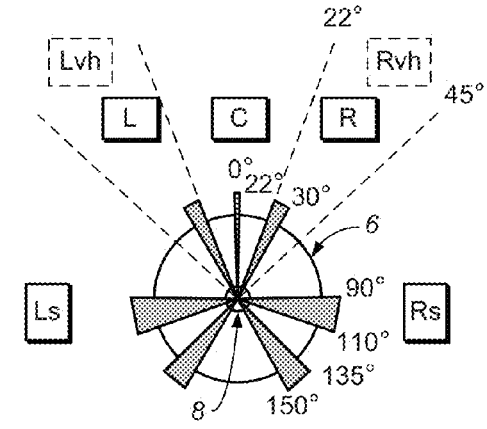
FIG. 5 shows the FIG. 1 example to which vertical height loudspeaker locations in accordance with aspects of the present invention have been added.

FIG. 5 shows the FIG. 1 example to which vertical height loudspeaker locations in accordance with aspects of the present invention have been added. A right vertical height (Rvh) loudspeaker location is shown in dashed lines (to indicate that it is above the right (R) loudspeaker location) within an angle range of 22 to 45 degrees with respect to the listening area center 4. A left vertical height (Lvh) loudspeaker location is shown in dashed lines (to indicate that it is above the left (L) loudspeaker location) within a mirror image of the angle range of 22 to 45 degrees with respect to the listening area center 8.

Figure 6:
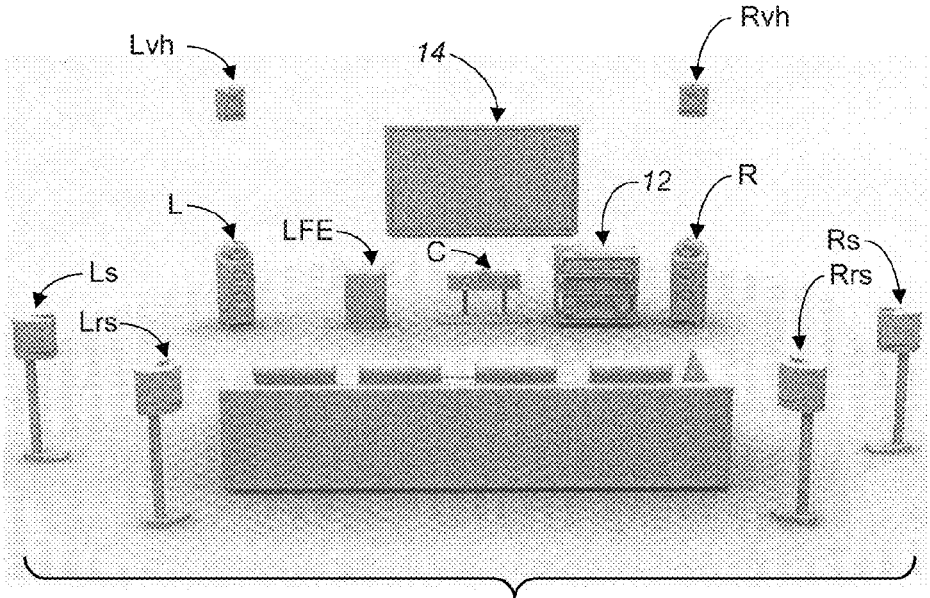
FIG. 6 shows the FIG. 5 example in a small room environment.

FIG. 6 shows the FIG. 5 example in a small room environment. A sofa 10 is located in the listening area 2. Loudspeakers are located at the L, LFE, C, R, Lvh, Rvh, Ls, Rs, Rrs and Lrs loudspeaker locations. Equipment associated with the multiple audio channels are shown schematically at 12. A video screen 13 is located above the center loudspeaker location.

It will be noted that the Lvh and Rvh loudspeaker locations are above the loudspeaker locations of the front audio channels. For example, it has been found that suitable Lvh and Rvh loudspeaker locations are at least one meter above the L and R loudspeaker locations and as high as possible. Also, although it has been found that the Lvh and Rvh loudspeaker locations may be at an angle wider than the L and R loudspeaker locations (up to 45 degrees rather than 30 degrees, for example), the Lvh and Rvh loudspeaker locations preferably are substantially directly above the L and R loudspeaker locations. It will also be noted that the Lvh and Rvh loudspeaker locations are above the Ls, Rs, Lrs and Rrs loudspeaker locations.

FIGS. 7-10 show examples of various ways according to aspects of the present invention in which signals for applying to loudspeakers at the Lvh and Rvh loudspeaker locations may be obtained.

Figure 7:
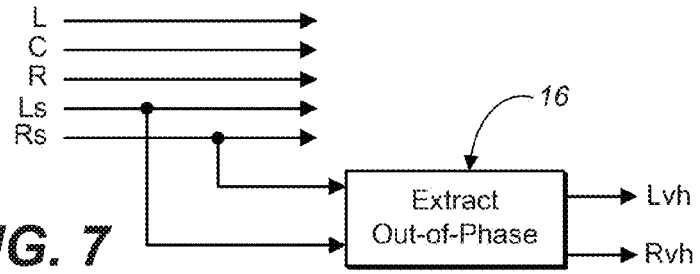

Referring first to FIG. 7, five audio channels (L, C, R, Ls and Rs) for applying to respective loudspeakers at the five loudspeaker locations common to the examples of FIGS. 1, 3 and 4 are shown. Out-of-phase sound information in the pair of channels intended for playback from the loudspeaker locations (Ls, Rs) at the sides of the listening area is extracted by an extractor or extracting process ("Extract Out-of-Phase") 16 to provide signals for application to loudspeakers at the Lvh and Rvh loudspeaker locations (FIGS. 3 and 4). Device or process 16 may be, for example, a passive or active matrix. A suitable passive matrix may be characterized as $$Lvh=[(0.871*Ls)-(0.49*Rs)], \text{ and}$$

$$Rvh=[(-0.49*Ls)+(0.871*Rs)].$$

The quiescent matrix condition of a suitable active matrix may also be characterized in the same manner.

Thus, the extracting device or process 16 extracts two audio signals, a left vertical height signal and a right vertical height signal, for coupling, respectively, to the left vertical height and right vertical height loudspeakers. Each of the vertical height signals comprise out-of-phase components in Ls and Rs channels, the left vertical height signal being weighted to the left side and/or left rear side channel in the pair of channels and the right vertical height signal being weighted to the right side and/or right rear side channel in the pair of channels by virtue of the matrix coefficients (0.871 and 0.49, in the example). Preferably, the vertical height signals are in-phase with respect to one another.

Figure 8:
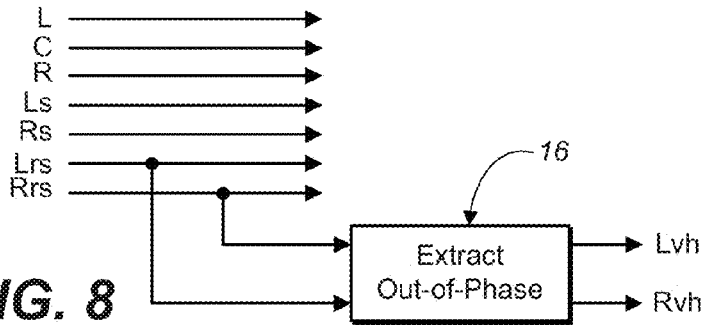

In the example of FIG. 8, seven audio channels (L, C, R, Ls, Rs, Lrs and Rrs) for applying to respective loudspeakers at the seven loudspeaker locations common to the examples of FIGS. 2, 5 and 6 are shown. Out-of-phase sound information in the pair of channels intended for playback from the loudspeaker locations (Ls, Rs) at the sides of the listening area is extracted by an extractor or extracting process ("Extract Out-of-Phase") 16 to provide signals for application to loudspeakers at the Lvh and Rvh loudspeaker locations (FIGS. 5 and 6). Device or process 16 may be, for example, a passive or active matrix. A suitable passive matrix may be characterized as $$Lvh=[(0.871*Lrs)-(0.49*Rrs)], \text{ and}$$

$$Rvh=[(-0.49*Lrs)+(0.871*Rrs)].$$

The quiescent matrix condition of a suitable active matrix may also be characterized in the same manner.

Thus, the extracting device or process 16 extracts two audio signals, a left vertical height signal and a right vertical height signal, for coupling, respectively, to the left vertical height and right vertical height loudspeakers. Each of the vertical height signals comprise out-of-phase components in Ls and Rs channels, the left vertical height signal being weighted to the left side and/or left rear side channel in the pair of channels and the right vertical height signal being weighted to the right side and/or right rear side channel in the pair of channels by virtue of the matrix coefficients (0.871 and 0.49, in the example). Preferably, the vertical height signals are in-phase with respect to one another.

Although it has been found suitable to extract the left vertical height signal and right vertical height signal from the Ls and Rs channel pair, the vertical height signals may also be extracted from the Lrs and Rrs channel pair.

Figure 9:
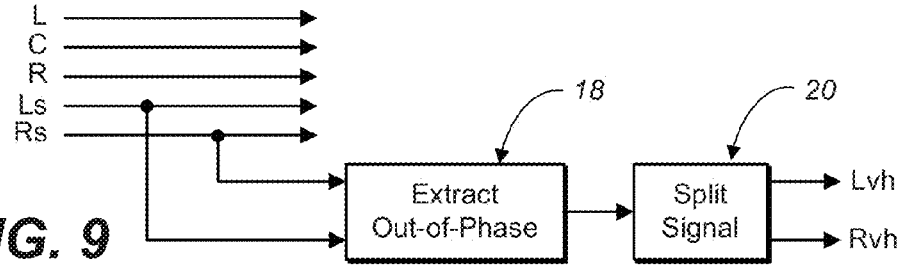

In the example of FIG. 9, five audio channels (L, C, R, Ls and Rs) for applying to respective loudspeakers at the five loudspeaker locations common to the examples of FIGS. 1, 3 and 4 are shown. Out-of-phase sound information in the pair of channels intended for playback from the loudspeaker locations (Ls, Rs) at the sides of the listening area is extracted by an extractor or extracting process ("Extract Out-of-Phase") 18 and a signal splitter or signal splitting process ("Split Signal") 20 to provide signals for application to loudspeakers at the Lvh and Rvh loudspeaker locations (FIGS. 3 and 4). In this example, the extracting device or process derives a single monophonic signal rather than two stereophonic-like signals as in the examples of FIGS. 7 and 8. Device or process 18 may be, for example, a passive or active matrix. A suitable passive matrix may be characterized as $$Lvh=Rvh=(Ls-Rs).$$

The quiescent matrix condition of a suitable active matrix may also be characterized in the same manner. The signal splitting device or process 20 may be considered to be part of the extracting device or process 18.

The single monophonic signal may be split into two copies of the same signal. Alternatively, some type of pseudo-stereo derivation may be applied to the monophonic signal.

Thus, the extracting device or process 18 extracts two audio signals, a left vertical height signal and a right vertical height signal, for coupling, respectively, to the left vertical height and right vertical height loudspeakers. Each of the vertical height signals comprise out-of-phase components in Ls and Rs channels. Preferably, the vertical height signals are in-phase with respect to one another.

Figure 10:
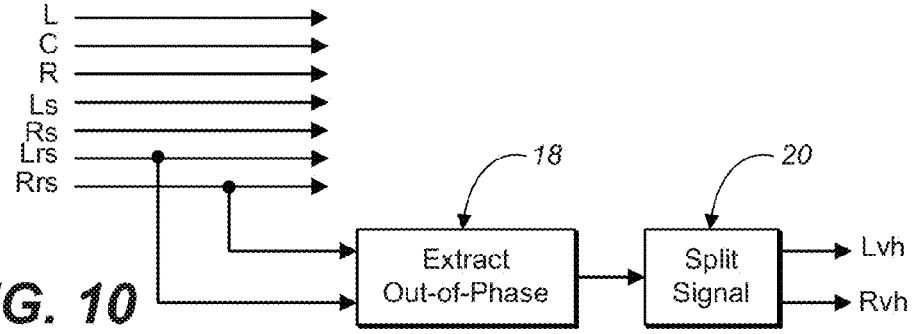

In the example of FIG. 10, seven audio channels (L, C, R, Ls, Rs, Lrs and Rrs) for applying to respective loudspeakers at the seven loudspeaker locations common to the examples of FIGS. 2, 5 and 6 are shown. Out-of-phase sound information in the pair of channels intended for playback from the loudspeaker locations (Ls, Rs) at the sides of the listening area is extracted by an extractor or extracting process ("Extract Out-of-Phase") 18 and a signal splitter or signal splitting process ("Split Signal") 20 to provide signals for application to loudspeakers at the Lvh and Rvh loudspeaker locations (FIGS. 3 and 4). In this example, the extracting device or process derives a single monophonic signal rather than two stereophonic-like signals as in the examples of FIGS. 7 and 8. Device or process 18 may be, for example, a passive or active matrix. A suitable passive matrix may be characterized as $$Lvh=Rvh=(Lrs-Rrs).$$

The quiescent matrix condition of a suitable active matrix may also be characterized in the same manner. The signal splitting device or process 20 may be considered to be part of the extracting device or process 18.

The single monophonic signal may be split into two copies of the same signal. Alternatively, some type of pseudo-stereo derivation may be applied to the monophonic signal.

Thus, the extracting device or process 18 extracts two audio signals, a left vertical height signal and a right vertical height signal, for coupling, respectively, to the left vertical height and right vertical height loudspeakers. Each of the vertical height signals comprise out-of-phase components in Ls and Rs channels. Preferably, the vertical height signals are in-phase with respect to one another.

Although it has been found suitable to extract the left vertical height signal and right vertical height signal from the Ls and Rs channel pair, the vertical height signals may also be extracted from the Lrs and Rrs channel pair.

In the various exemplary embodiments of FIGS. 3-10, the multiple audio channels (L, C, R, Ls, Rs, Lvh, Rvh; L, C, R, Ls, Rs, Lrs, Rrs, Lvh, Rvh) may be audio channels derived from a pair of audio source signals. Such pair of audio signals may be a stereophonic pair of audio signals into which directional information is encoded. A pair of independent signals representing respective channels intended for playback to the sides and/or rear of the listening area may be encoded with out-of-phase vertical height information. In the absence of such encoding, which may be difficult to implement, the vertical height signals obtained may be considered to be pseudo-height signals. It is an aspect of the present invention that, in view of their manner of derivation, such pseudo-height signals are unlikely to include sounds that are non-sensical or out-of-place when reproduced by loudspeakers in the Lvh and Rvh positions. Such pseudo-height signals will comprise mainly ambient or diffuse sounds present in the side or rear side channels.

Alternatively, the multiple audio channels may be derived from more than two audio source signals comprising independent (or discrete) signals representing respective channels intended for playback to the front of the listening area and to the sides and/or rear of the listening area. A pair of independent signals representing respective channels intended for playback to the sides and/or rear of the listening area may be encoded with out-of-phase vertical height information. In that case, sounds may be explicitly located for playback by loudspeakers at the Lvh and Rvh loudspeaker locations.

For simplicity the various figures do not show relative time delays and gain adjustments as may be necessary in implementing a practical sound reproduction arrangement. The manner of implementing such time delays and gain adjustments are well known in the art and do not form a part of the present invention.

It will be understood that the arrangements of FIGS. 1-6 for reproducing multiple audio channels are examples of environments for aspects of the present invention. For example, the angular locations of the loudspeaker locations in the FIG. 1 and FIG. 2 examples are not critical to the invention. Also, it should also be understood that more than one loudspeaker may be placed at or in proximity to a loudspeaker location.

IMPLEMENTATION

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

I claim:

1. A method of enhancing the reproduction of multiple audio channels, the channels including channels intended for playback to the front (L, R) of a listening area and a pair of channels intended for playback to the sides (Ls, Rs) of the listening area and/or a pair of channels intended for playback to the rear (Lrs, Rrs) of the listening area, comprising:

extracting two audio signals, a left vertical height signal and a right vertical height signal, from (a) the pair of channels intended for playback to the sides (Ls, Rs) of the listening area or (b) the pair of channels intended for playback to the rear sides (Lrs, Rrs) of the listening area, each of the vertical height signals comprising out-of-phase components in the pair of channels from which it is extracted, wherein said extracting extracts said out-of-phase sound information using an extractor, and applying said left and right vertical height signals to left vertical height (Lvh) and right vertical height (Rvh) loudspeakers, the left vertical height signal being weighted to the left side and/or left rear side channel in the respective pair of channels and the right vertical height signal being weighted to the right side and/or right rear side channel in the respective pair of channels, the vertical height loudspeakers being located at the front of the listening area and above loudspeakers playing back the channels intended for playback to the front (L, R) of the listening area, one or more left vertical height loudspeakers being located above one or more loudspeakers that reproduce the left front channel and one or more right vertical height loudspeakers being located above one or more loudspeakers that reproduce the right front channel, wherein the pair of channels from which the out-of-phase sound information is extracted may be designated Ls and Rs and the extracted out-of-phase sound information may be designated Lvh and Rvh, such that the relationships among Lvh, Rvh, Ls and Rs may be characterized by $$Lvh=[(0.871*Ls)-(0.49*Rs)], \text{ and}$$

$$Rvh=[(-0.49*Ls)+(0.871*Rs)].$$

2. A method according to claim 1 wherein said extracting extracts a single-channel monophonic audio signal comprising out-of-phase components in each of said pair of channels) and divides the monophonic audio signal into two signals, a left vertical height signal and a right vertical height signal, for application, respectively, to said left vertical height (Lvh) and right vertical height (Rvh) loudspeakers.

3. A method according to claim 2 or claim 1 wherein the signals applied to said left vertical height (Lvh) and right vertical height (Rvh) loudspeakers are in phase with each other.

4. A method according to claim 1 wherein there is one pair of channels intended for playback to the sides (Ls, Rs) of the listening area, a left surround channel and a right surround channel.

5. A method according to claim 1 wherein there is one pair of channels intended for playback to the rear sides (Lrs, Rrs) of the listening area, a left rear surround channel and a right rear surround channel.

6. A method according to claim 1 wherein there are a pair of side surround channels intended for playback to the sides (Ls, Rs) of the listening area, and a pair of rear surround channels intended for playback to the rear sides (Lrs, Rrs) of the listening area, and wherein said pair of side surround channels are the left surround and right surround channels and the pair of rear surround channels are the left rear surround and right rear surround channels.

7. A method according to claim 1 wherein said extractor comprises one of a passive matrix or an active matrix.

8. A method according to claim 1 wherein said multiple audio channels are derived from a pair of audio source signals.

9. A method according to claim 8 wherein said pair of audio signals are a stereophonic pair of audio signals into which directional information is encoded.

10. A method according to claim 1 wherein said multiple audio channels are derived from more than two audio source signals comprising independent signals representing respective channels intended for playback to the front of the listening area and to the sides and/or rear of the listening area.

11. A method according to claim 10 wherein a pair of independent signals representing respective channels intended for playback to the sides and/or rear of the listening area is encoded with out-of-phase vertical height information.

12. Apparatus adapted to practice the method of claim 1.

13. A non-transitory computer-readable storage medium encoded with a computer program for causing a computer to perform the method of any one of claim 2 or 1.

14. A method according to claim 1 wherein said pair of channels intended for playback to the sides (Ls, Rs) of the listening area are applied to loudspeakers located at the sides (Ls, Rs) of the listening area.

15. A method according to claim 1 wherein said pair of channels intended for playback to the rear sides (Lrs, Rrs) of the listening area are applied to loudspeakers located at the rear sides (Lrs, Rrs) of the listening area.

16. A method according to claim 1 wherein said pair of channels intended for playback to the sides (Ls, Rs) of the listening area are applied to loudspeakers located at the sides (Ls, Rs) of the listening area and wherein said pair of channels intended for playback to the rear sides (Lrs, Rrs) of the listening area are applied to loudspeakers located at the rear sides (Lrs, Rrs) of the listening area.

* * * * *